US008752527B2

(12) United States Patent
Worthington et al.

(10) Patent No.: US 8,752,527 B2
(45) Date of Patent: Jun. 17, 2014

(54) ASSEMBLY FOR CONNECTING DOUBLE HIGH PRESSURE WALL LINE TO A SINGLE-WALLED HIGH PRESSURE CONNECTOR

(75) Inventors: Joseph Worthington, Seymour, IN (US); Thomas O. Hahn, Columbus, IN (US); Vijay Sonawane, Pune (IN); Prasad Khedekar, Pune (IN); Dave Richter, Columbus, IN (US); Josh Knight, Columbus, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 378 days.

(21) Appl. No.: 13/104,949

(22) Filed: May 10, 2011

(65) Prior Publication Data

US 2012/0006299 A1 Jan. 12, 2012

Related U.S. Application Data

(60) Provisional application No. 61/333,083, filed on May 10, 2010.

(51) Int. Cl.
*F02M 55/02* (2006.01)

(52) U.S. Cl.
USPC ..... 123/469; 123/456

(58) Field of Classification Search
CPC ..... F02M 37/00; F02M 47/02; F02M 55/02; F02M 69/46; F16L 9/18; F16L 19/02; F16L 19/04; F16L 27/12; F16L 33/01; F16L 59/12; F02D 17/04; B23P 19/04
USPC ..... 123/456, 467–469, 514, 198 D; 29/888.01; 138/109, 114, 148; 285/145.1, 145.4, 302, 354, 386
See application file for complete search history.

(56) References Cited

U.S. PATENT DOCUMENTS 4,149,568 A 4/1979 Kuntz et al.
5,076,242 A * 12/1991 Parker ..... 123/514

(Continued)

FOREIGN PATENT DOCUMENTS

EP 2011996 A1 1/2009

*Primary Examiner* — John Kwon
*Assistant Examiner* — Johnny Hoang
(74) *Attorney, Agent, or Firm* — Faegre Baker Daniels LLP

(57) ABSTRACT

This disclosure provides a fuel line assembly for use with an internal combustion engine, an internal combustion engine including such as fuel line assembly, and a method for providing leak containment and detection in a fuel system, each of which include a double-walled fuel line including a high pressure fuel line component. The double-walled fuel line includes a high pressure fuel line, a jacket surrounding the high pressure fuel line, and a low pressure passage between the high pressure fuel line and the jacket. A fuel line nut includes a main body that houses a portion of the high pressure fuel line, and a first end portion supporting an enlarged end portion of the high pressure fuel line protruding from the first end portion. A second end portion of the fuel line nut sealingly connects to the jacket to extend the low pressure passage into an area between the main body and the housed high pressure fuel line. A fuel line connector mechanically and sealingly engages with the fuel line nut to house the supported enlarged end portion of the high pressure fuel line. The fuel line connector can connect to a single-walled high pressure tube provided in a bore of the cylinder head between an inlet of a fuel injector and the environment exterior of the cylinder head.

8 Claims, 2 Drawing Sheets

(56) References Cited

U.S. PATENT DOCUMENTS

| | | | | |
|---|---|---|---|---|
| 5,239,964 | A * | 8/1993 | Diener et al. | 123/456 |
| 5,724,946 | A * | 3/1998 | Franchitto | 123/470 |
| 6,234,413 | B1 * | 5/2001 | Greaney | 239/533.2 |
| 6,286,556 | B1 | 9/2001 | Kato | |
| 6,827,065 | B2 | 12/2004 | Gottemoller et al. | |
| 7,337,652 | B2 | 3/2008 | Shamine | |
| 8,272,368 | B2 * | 9/2012 | Wickstone | 123/468 |
| 2011/0041934 | A1 * | 2/2011 | Holler | 137/561 R |
| 2012/0012083 | A1 * | 1/2012 | Tower et al. | 123/468 |

* cited by examiner

ASSEMBLY FOR CONNECTING DOUBLE HIGH PRESSURE WALL LINE TO A SINGLE-WALLED HIGH PRESSURE CONNECTOR

RELATED APPLICATIONS

This application claims benefit of priority to Provisional Patent Application No. 61/333,083, filed on May 10, 2010, the entire contents of which are hereby incorporated by reference.

FIELD OF THE INVENTION

The invention relates to a fuel line assembly for use with an internal combustion engine, and more particularly, to a fuel line assembly that contains and detects fuel leakage and includes a double-walled fuel injection line and a single-walled high pressure connector.

BACKGROUND

Marine Agency safety requirements, such as the International Convention for the Safety of Life at Sea (SOLAS) treaty, require double-walled fuel injection lines (also known as double skinned, jacketed or sheathed fuel lines or pipes) to contain fuel leaks and prevent the likelihood of fuel spillage and fire on a commercial marine vessel. A gap provided between inner and outer walls of the double-walled fuel injection lines provide a low pressure passage that can channel any fuel leaking from the high pressure inner wall to a leakage detecting system. At the same time, the outer wall contains, collects and/or recycles the leaking fuel to prevent fuel spillage onto hot engine components, which can cause fires or present other safety hazards.

SUMMARY

This disclosure provides a fuel line assembly for use with an internal combustion engine, an internal combustion engine including such as fuel line assembly, and a method for providing leak containment and detection in a fuel system, each of which include a double-walled fuel line including a high pressure fuel line component.

In a disclosed embodiment, a fuel line assembly for supplying fuel to an internal combustion engine includes a double-walled fuel line including a high pressure fuel line, a jacket surrounding the high pressure fuel line, and a low pressure passage between the high pressure fuel line and the jacket. A fuel line nut including a main body houses a portion of the high pressure fuel line and includes a first end portion supporting an enlarged end portion of the high pressure fuel line protruding from the first end portion. A second end portion of the fuel line nut sealingly connects to the jacket to extend the low pressure passage formed by the high pressure fuel line and the jacket into the an area between the main body and the housed high pressure fuel line. A fuel line connector mechanically and sealingly engages with the fuel line nut to house the supported enlarged end portion of the high pressure fuel line.

In a more specific embodiment, the fuel line assembly includes a single-walled high pressure connector tube including a central axis, a first end portion fluidly connected with the enlarged end portion of high pressure fuel line, a second end portion for sealingly engaging a fuel injector inlet port, and a pivoting element positioned between the first and second end portions and extending outwardly from the central axis. In the more specific embodiment, a clamp nut is provided to secure the single-walled high pressure connector tube within a bore in a cylinder head of an internal combustion engine via an end portion that applies force to the pivoting element and urges the second end portion of the single walled high pressure connector tube into the sealing engagement with a fuel injector inlet port of the injector.

In another disclosed embodiment, an internal combustion engine includes plural cylinders, where each cylinder is associated with one of plural fuel injectors. A cylinder head covers the cylinders and housing the injectors. Each of plural bores in the cylinder head open at a first end thereof to an inlet port of one of the fuel injectors and to an exterior surface of the cylinder head at a second end thereof. The internal combustion engine includes plural double-walled fuel lines, each having a high pressure fuel line, a jacket surrounding the high pressure fuel line, and a low pressure passage between the high pressure fuel line and the jacket. For each of these double-walled fuel lines, a fuel line nut including a main body houses a portion of the high pressure fuel line, the fuel line nut includes a first end portion supporting an enlarged end portion of the high pressure fuel line protruding from the first end portion, and a second end sealingly connected to the jacket to extend the low pressure passage into the an area between the main body and the housed high pressure fuel line, a fuel line connector mechanically and sealingly engages with the fuel line nut and houses the supported enlarged end portion of the high pressure fuel line, a single-walled high pressure connector tube having a first end portion sealingly engages with the enlarged end portion of the high pressure fuel line and a second end portion sealingly engages with an inlet port of one of the plural fuel injectors, and a clamp nut includes a portion securing the single-walled high pressure connector tube within the bore in the cylinder head and urges the second end portion of the single walled high pressure connector tube into the sealing engagement with the fuel injector inlet port.

In yet another disclosed embodiment, a method for providing leak containment and detection in a fuel system includes inserting a double-walled fuel line into a first end portion of a main body of a fuel line nut. The double-walled fuel line has a high pressure fuel line, a jacket surrounding the high pressure fuel line and terminating in the main body, and a low pressure passage between the high pressure fuel line and the jacket. A portion of the inserted high pressure fuel line extends from a second end portion of the main body of the fuel line nut. The method includes providing a spacer on the high pressure fuel line extending from the main body, forming a compression fitting surface on an end portion of the high pressure fuel line extending from the spacer, and sealingly connecting a fuel line nut to a main body of a fuel line connector such that the compression fitting is housed inside the main body.

DETAILED DESCRIPTION

The inventors realized that a single-wall high pressure connector tube can fluidly connect with a high pressure fuel line of a double-wall fuel injection line while using structure of an existing bore formed in a cylinder head of an engine to provide an effective secondary wall around the single-walled high pressure connector tube and contain any fuel leaking from the single-wall high pressure connector tube or from the fuel injector that can enter the bore. A fuel leak from the high pressure fuel line of the double-wall high pressure fuel line would drain in a direction of a leakage detector and container, for example, a fuel sensing system that detects such a fuel leak and containment vessel, such as the fuel tank. A fuel leak from the single-wall high pressure connector would be contained with the effective secondary wall provided by the cylinder head bore, and also can be directed to a leakage detector and containment vessel, for example, a same one used to detect and contain leaks present in the double-walled fuel injection line. This allows for use of a single-walled high pressure connector, such as those already existing, to interface with a double-wall fuel injection line while meeting safety requirements (e.g., SOLAS). In this way, the expense and time that would be associated with developing a complex double-wall high pressure connector can be avoided.

The inventors also realized that misalignment can occur between the fuel injector and the single-wall high pressure connector and/or a high pressure connector bore formed in a cylinder head, for example, due to variations in manufacture of these components. Embodiments described herein allow for some misalignment of the single-wall high pressure connector and/or a high pressure connector bore when assembling fuel line components.

Figure 1:
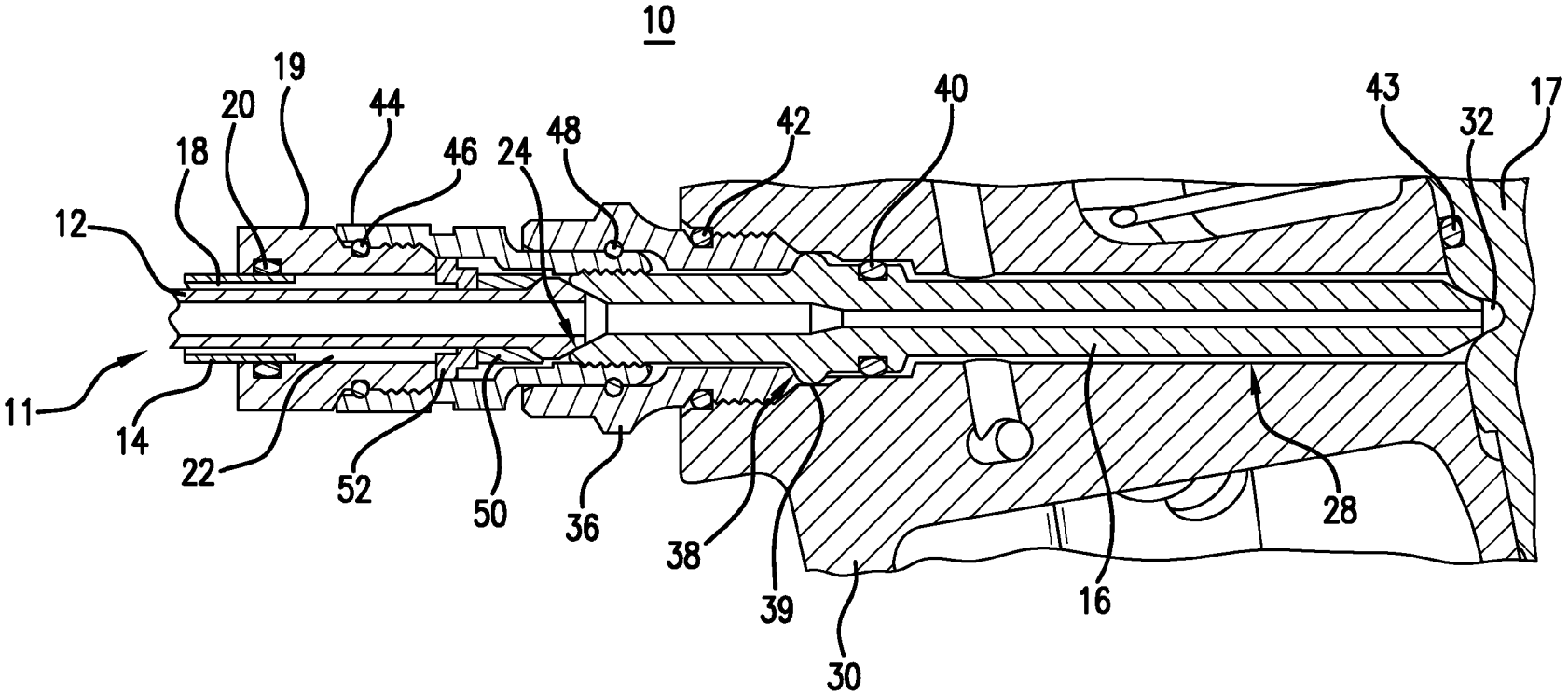
FIG. 1 is a diagram showing a cross section of a fuel line assembly and high pressure connector tube according to an exemplary embodiment.

Referring now to the drawings, FIG. 1 shows a cross-section view of a fuel line assembly 10 according to an exemplary embodiment. The fuel line assembly 10 can be used to supply fuel injectors of an internal combustion engine including plural cylinders formed in an engine block (not shown), where each cylinder is associated with a fuel injector. The injectors are contained in a cylinder head that covers the cylinders to form a combustion chamber for each cylinder.

The fuel line assembly 10 includes a double-walled fuel injection line 11 for each of the cylinders and associated fuel injector, and each double-walled fuel injector line 11 includes a high pressure fuel line 12 and a jacket 14 surrounding the high pressure fuel line 12. The high pressure fuel line 12 is a portion of a high pressure fuel circuit that can include a high pressure fuel line from a high pressure (HP) fuel pump (not shown), a high pressure common rail (not shown) receiving the fuel from the HP fuel pump, a fuel injector connector tube 16 connecting the high pressure fuel line 12 to a fuel injector 17, of which only a portion is shown. The jacket 14 can be a tubular shaped segment forming an outer wall of the double-walled fuel line structure to define an annular shaped low pressure passage 18 around the high pressure fuel line 12. The low pressure passage 18 is part of a low pressure circuit that contains leaking fuel and allows the leaking fuel to drain to a leak detector, such as a fuel sensing system (not shown) that can detect a fuel leak in the high pressure fuel line 12. Upon detection of a fuel leak in the low pressure passage, an alarm can be triggered to alert the operator via an audible and/or displayed indication or message.

As shown in FIG. 1, the jacket 14 of double-walled fuel injection line 11 is provided in sealing engagement at one end of a fuel line nut 19 via an o-ring 20, which extends the low pressure circuit from the annular shaped passage 18 of fuel injection line to a passage 22 between the inner surface of the fuel line nut 19 and the outer surface of the high pressure fuel line 12. It is to be understood that the low pressure passage can be part of a larger continuous low pressure circuit that includes low pressure passages surrounding other high pressure elements of the fuel system, including the fuel drain line leading to the leakage detector, the fuel tank, a leaked fuel container etc.

A mechanical seal 24 is formed between a conically shaped end portion the high pressure fuel line 12 of the double-walled fuel injection line 11 and complementary shaped first end portion of the single-walled high pressure fuel injector connector tube 16. The high pressure fuel injector connector tube 16 is provided in a bore 28 formed in a cylinder head 30 of an internal combustion engine. A second end portion of the high pressure fuel injector connector tube 16 is held in pressure sealing engagement with an inlet port 32 of the fuel injector 17, of which only a side portion is shown by a clamp nut 36 provided in threaded engagement with the cylinder head 30. The clamp nut 36 includes an end portion that forms an interface 38 with a pivoting element provided on the high pressure connector tube 16, such as a ball seat 39.

O-rings 40 and 42 form seals between the high pressure connector 16 and the bore 28. A can be seen from the fuel line assembly 10, the seal provided by o-ring 40 between the cylinder head bore 28 and the high pressure connector, and the seal formed by o-ring 42 between the clamp nut 36 and the cylinder head bore 28 provide a barrier to fuel leaks that may occur in the cylinder head bore 28. Additionally, an o-ring 43 on the fuel injector 17 provides a seal between the body of the fuel injector 17 and a bore in the cylinder head 30 in which the fuel injector is provided. Fuel leaking from high pressure connector tube 16 and/or the body of the fuel injector 17 can be contained in a low pressure region that includes the region between an outer surface of the high pressure connector tube 16 and the cylinder head bore 28. Thus, the cylinder head bore 28 of the fuel line assembly 10 provides an effective second wall to contain any fuel leaking from the single-walled high pressure connector 16 within the cylinder head bore 28 or the body of the fuel injector 17. Fuel in the low pressure region of the cylinder head bore can be directed, for example, via passages formed in the cylinder head (not shown), to a leak detection device (not shown). The leak detection device can be a same one used to detect leaks in the low pressure circuit of the fuel line 11 or a separately provided leak detection device.

A fuel line connector 44 is in threaded connection with the fuel line nut 19 at a first end portion thereof and in threaded connection with the high pressure connector tube 16 at a second end portion thereof. An o-ring 46 provides a seal between the fuel line nut 19 and the fuel line connector 44. When threading the fuel line connector 44 onto the high pressure connector tube 16, the high pressure connector tube 16 is allowed to pivot on its ball seat 39, and only interfaces the clamp nut 36 via an o-ring 48 that seals the space between the single-walled high pressure connector 16 and the clamp nut 36. The high pressure fuel line 12 uses a sleeve 50 and a spacer 52 to apply force on the conical end of the high pressure fuel line 12, via tightening a threaded engagement of the fuel line nut 19 with the fuel line connector 44 and the threaded engagement of the connector 44 with the high pressure connector 16, to provide the mechanical seal 24 between the high pressure fuel line 12 to the single-walled high pressure connector 16. The fuel line spacer 52 can include passages that allow leaking fuel at low pressure to pass across the fuel line spacer 52 and drain into the fuel sensing system for leak detection.

The interface 38 formed between the ball seat 39 on the high pressure connector 16 and the end portion of the clamp nut 36 allows for misalignment (e.g., from manufacturing variability) between the single-walled high pressure connector tube 16 threaded together with the high pressure fuel line 12 and the high pressure connector bore (port) 28 in the cylinder head 30. For example, allowing for misalignment can compensate for machining variability in the high pressure connector port 28 on the cylinder head 30, machining variability in the fuel inlet 32 on the fuel injector 17, crush variability of the sealing washer (not shown) between the injector and cylinder head 30, and/or bending variability of the double-wall fuel injection line 11. This misalignment is compensated for by several key features.

One compensation feature is the ball shape on the high pressure connector 16 and clamp nut 36 that threads into the cylinder head 30. While the clamp nut 36 is fixed with respect to the cylinder head 30, the high pressure connector 16 is free to pivot at the ball seat interface between the ball seat 39 and the clamp nut 36 to ensure alignment for sealing with the fuel inlet port 32 of the fuel injector 17.

Another compensation feature is the fuel line connector 44 on the double-wall fuel injection line 11 threads directly onto the high pressure connector tube 16, which is allowed to pivot against the ball seat 39, and preferably only interfaces with the clamp nut 36 via a sealing engagement with an o-ring 48, although incidental contact between the clamp nut 36 and the fuel line connector 44 can occur. This allows both the high pressure connector tube 16 and high pressure fuel line 12 to be misaligned relative to the bore 28 in the cylinder head 30 while ensuring any fuel leaked from the high pressure fuel line 12 of the double-wall fuel injection line 11 is contained and plumbed to the leakage detection device or system (e.g., a fuel sensing system) without spilling externally and potentially causing a fire.

Figure 2:
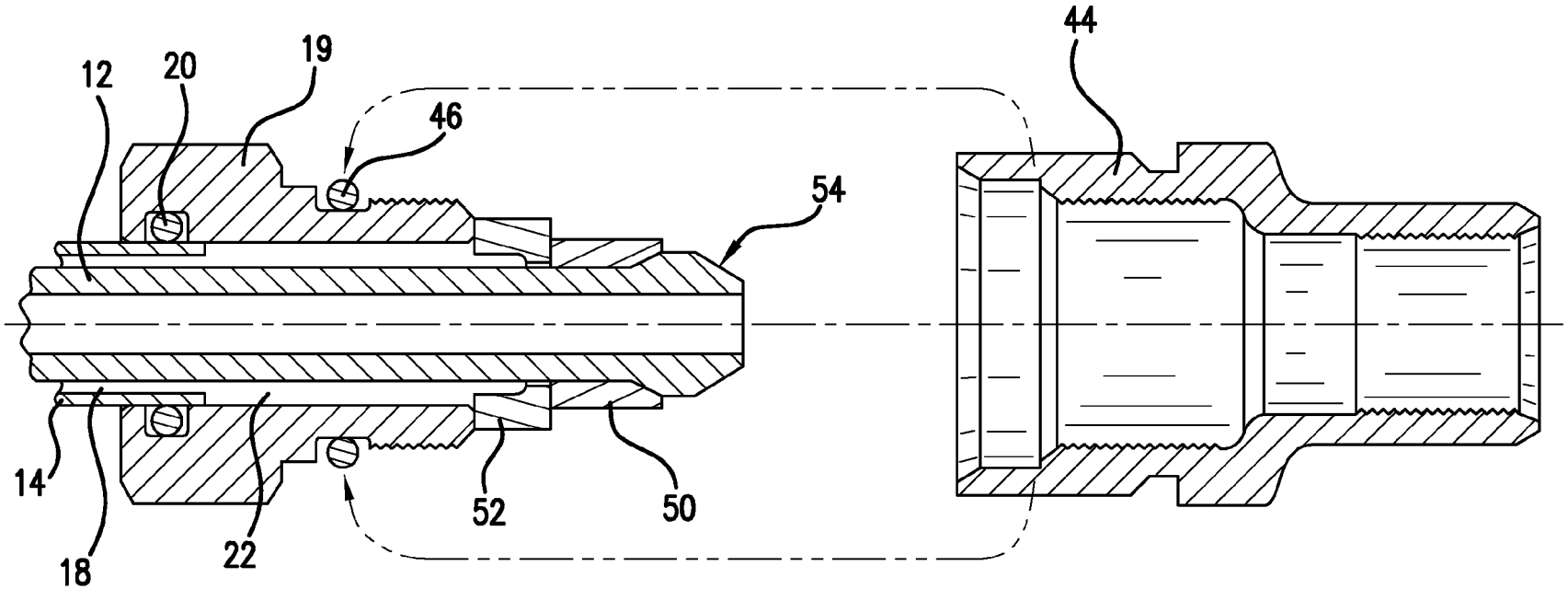
FIG. 2 is a diagram showing a cross section of a portion of the fuel system elements of the fuel line assembly shown in FIG. 1 prior to assembling the elements.

FIG. 2 is a cross-section view of portion of the fuel system elements of the fuel line assembly shown in FIG. 1 prior to assembling the elements, and shows an exemplary assembly process of double-wall fuel injection line 11, fuel line nut 19, spacer 52, sleeve 50 and the fuel line connector 44. As shown in FIG. 2, the fuel line nut 19 and the fuel line connector 44 are two separate pieces to ensure the sleeve 52 and spacer 50 are properly sized to ensure adequate sealing force on the conical sealing interface 24 between the high pressure fuel line 12 and the single-wall high pressure connector tube 16. The design of separate fuel line nut 19 and fuel line connector 44 pieces allows assembling the fuel line nut 19 with the o-ring seal 46 onto the double-walled fuel line 11, and then installing the spacer 52 and sleeve 50 before an end portion of the high pressure fuel line 12 is swaged, flared or otherwise worked to provide sealing surface than can form a compression fitting with a complementary surface at an end portion of the single-wall high pressure connector tube 16, such as the conical surface 54. The fuel line connector 44 is thereafter attached, for example, via a threaded connection, onto the fuel line nut 19.

Without the use of clamp nut 36, a unique double-walled high pressure connector would have to be designed to ensure all fuel plumbing is double-walled, leading to a more complicated, expensive design. A double-walled high pressure connector that threaded directly to the connector on the double-walled fuel line would also not compensate for any misalignment between a high pressure connector and high pressure connector port. Embodiments of the present disclosure can use existing inexpensive single-walled high pressure connector tubes and meet safety features required by marine agencies, such as SOLAS. Additionally, the claimed invention provides ways to inexpensively allow for manufacturing variability (e.g., machining variability in the cylinder head and/or bending variability in the high pressure inner fuel line portion of a fuel injection line) to ensure proper sealing between the fuel inlet port of a fuel injector and a high pressure connector as well as proper sealing on a high pressure inner line portion of a double-walled fuel injection line and a high pressure connector. Also, disclosed embodiments can provide additional protection to a single-wall high pressure connector tube by effectively making the design double-walled.

Although a limited number of embodiments is described herein, one of ordinary skill in the art will readily recognize that there could be variations to any of these embodiments and those variations would be within the scope of the appended claims. Thus, it will be apparent to those skilled in the art that various changes and modifications can be made to the fuel line assembly including high pressure double-wall fuel line and single-walled high pressure connector described herein without departing from the scope of the appended claims and their equivalents.

What is claimed is:

1. A fuel line assembly for supplying fuel to an internal combustion engine, comprising:

a double-walled fuel line including a high pressure fuel line, a jacket surrounding the high pressure fuel line, and a low pressure passage between the high pressure fuel line and the jacket;

a fuel line nut including a main body that houses a portion of the high pressure fuel line, said fuel line nut including a first end portion supporting an enlarged end portion of the high pressure fuel line protruding from the first end portion and a second end portion sealingly connected to the jacket to extend the low pressure passage into an area between the main body and the housed high pressure fuel line;

a fuel line connector mechanically and sealingly engaged with the fuel line nut to house the supported enlarged end portion of the high pressure fuel line;

a single-walled high pressure connector tube including a central axis, a first end portion fluidly connected with the enlarged end portion of high pressure fuel line, a second end portion for sealingly engaging a fuel injector inlet port, and a pivoting element positioned between the first and second end portions and extending outwardly from the central axis; and a clamp nut including a portion for securing the single-walled high pressure connector tube within a bore in a cylinder head of an internal combustion engine via an end portion applying force to the pivoting element and urging the second end portion of the single-walled high pressure connector tube into the sealing engagement with a fuel injector inlet port of the injector;

wherein the fuel line connector mechanically fastens to the first end portion of the single-walled high pressure connector tube, but not to the clamp nut, to allow pivoting the single-walled high pressure connector at the interface with the pivoting element.

2. The fuel line assembly according to claim 1, wherein the low pressure passage is fluidly coupled to a leakage detector.

3. The fuel line assembly according to claim 2, further comprising an alarm triggerable with detection of fuel in the low pressure passage by the leakage detector.

4. The fuel line assembly according to claim 1, wherein supporting the enlarged end portion of high pressure fuel line includes providing a spacer around the high pressure fuel line between the enlarged end portion of the high pressure fuel line and the first end portion of the fuel line nut, said spacer including at least one passage through which the low pressure passage of the double-walled fuel line extends in a direction toward the enlarged end portion.

5. An internal combustion engine, comprising:

plural cylinders, each said cylinder associated with one of plural fuel injectors;

a cylinder head covering the cylinders and housing the injectors;

plural bores in the cylinder head, each said bore opening at a first end thereof to an inlet port of one of the fuel injectors and to an exterior surface of the cylinder head at a second end thereof;

plural double-walled fuel lines, each said double-walled fuel line including a high pressure fuel line, a jacket surrounding the high pressure fuel line, and a low pressure passage between the high pressure fuel line and the jacket; and for each double-walled fuel line:

a fuel line nut including a main body houses a portion of the high pressure fuel line, said fuel line nut including a first end portion supporting an enlarged end portion of the high pressure fuel line protruding from the first end portion and a second end sealingly connected to the jacket to extend the low pressure passage into the an area between the main body and the housed high pressure fuel line;

a fuel line connector mechanically and sealingly engages with the fuel line nut and housing the supported enlarged end portion of the high pressure fuel line;

a single-walled high pressure connector tube has a first end portion sealingly engaged with the enlarged end portion of the high pressure fuel line, and a second end portion sealingly engaged with an inlet port of one of the plural fuel injectors; and a clamp nut includes a portion securing the single-walled high pressure connector tube within the bore in the cylinder head and urges the second end portion of the single-walled high pressure connector tube into the sealing engagement with the fuel injector inlet port;

wherein the single-walled high pressure connector tube includes a central axis and a ball seat positioned between the first and second end portions and extending outwardly from the central axis, and the clamp nut includes an end portion forming an interface with the ball seat; and wherein the fuel line connector mechanically fastens to the first end portion of the single-walled high pressure connector tube, but not to the clamp nut, to allow pivoting the single-walled high pressure connector at the interface with the ball seat.

6. The internal combustion engine according to claim 5, wherein the low pressure passage is fluidly coupled to a fuel leakage detector.

7. The internal combustion engine according to claim 6, further comprising an alarm triggerable with detection of fuel in the low pressure passage by the leakage detector.

8. The internal combustion engine according to claim 5, wherein supporting the enlarged end portion of high pressure fuel line includes providing a spacer around the high pressure fuel line between the enlarged end portion of the high pressure fuel line and the first end portion of the fuel line nut, said spacer including at least one passage through which the low pressure passage of the double-walled fuel line extends toward the enlarged end portion.

* * * * *